US005553576A

United States Patent [19]

Nikly

[11] Patent Number: 5,553,576

[45] Date of Patent: Sep. 10, 1996

[54] VEHICLE MOTORIZATION UNIT

[75] Inventor: Jean Nikly, Saint-Cyr au Mont d'Or, France

[73] Assignee: Wartsila Sacam Diesel S.A., Mulhouse, France

[21] Appl. No.: 509,760

[22] Filed: Aug. 3, 1995

[30] Foreign Application Priority Data

Aug. 11, 1994 [FR] France ..... 94 10058

[51] Int. Cl.[6] ..... F01P 9/00

[52] U.S. Cl. ..... 123/41.01; 123/DIG. 8; 60/714

[58] Field of Search ..... 123/41.01, 41.29, 123/DIG. 8; 60/714

[56] References Cited

U.S. PATENT DOCUMENTS

| | | | |
|---|---|---|---|
| 1,176,309 | 3/1916 | Müuller | 123/DIG. 8 |
| 1,974,907 | 9/1934 | Worth | 60/714 |
| 2,084,187 | 6/1937 | Brehob | 60/714 |

FOREIGN PATENT DOCUMENTS

| | | |
|---|---|---|
| 884163 | 8/1943 | France . |
| 2250381 | 5/1975 | France . |
| 545573 | 6/1942 | United Kingdom . |
| 548593 | 10/1942 | United Kingdom . |
| 665526 | 1/1952 | United Kingdom . |

*Primary Examiner*—Noah P. Kamen
*Attorney, Agent, or Firm*—Davis, Bujold & Streck, P.A.

[57] ABSTRACT

A motorization unit comprising two internal combustion engines able to run alternately or simultaneously.

The two engines (20, 40) each comprise their own cooling circuit (21, respectively 41). These two circuits are each provided with an expansion vessel (26, 46) and are connected to a heat exchanger (30). The purpose of this heat exchanger is to keep the cooling circuit of one of the engines not running, at the right temperature by means of the cooling circuit of the other engine which is running, when the unit is operating in alternate mode.

This motorization unit can be adapted to road, rail and aquatic vehicles.

6 Claims, 2 Drawing Sheets

VEHICLE MOTORIZATION UNIT

BACKGROUND OF THE INVENTION (1) Field of the Invention

The present invention relates to a motorization unit for road, rail and aquatic vehicles comprising at least two internal combustion type engines designed to operate alternately or simultaneously, each having its own cooling circuit.

(2) Description of the Prior Art

The reliability of motorization, traction or propulsion units is one of the main requirements imposed on vehicles, primarily rail vehicles but also aquatic vehicles, because when the engine of a locomotive or boat breaks down, serious action has to be taken immediately, creating dangers which put the safety of the users at risk. Consequently, one of the permanent concerns of transport companies is to seek solutions which contribute to improving this reliability, i.e. reducing the risks of breakdowns.

One of the obvious ways consists in doubling the traction or propulsion units. Many trains are pulled in this way by two or more locomotives, generally moreover to reach the required power which one locomotive alone can not provide. Secondarily, this duplication of the traction units also solves, at least partially, the problem of safety, even if in the event of one of the locomotives breaking down, the train can no longer reach its optimum speed.

Again for safety reasons, an increasing number of pleasure craft are also equipped with two engines, generally used alternately when cruising. The combined power of both engines is only required during peak use or for difficult passages in rough seas.

However, these motorization units are always independent and, particularly when it comes to trains, each locomotive with an internal combustion engine is only equipped with one engine of this type.

In the case of a train with a single locomotive, the problem of safety is not overcome, even if statistically the risk of a breakdown resulting in the train having to stop on the line is in the region of 0.2%.

SUMMARY OF THE INVENTION

The present invention proposes to provide a simple, efficient and economical solution to considerably reduce this risk and increase the reliability of the vehicle motorization units of the type mentioned above.

With this aim in mind, the invention relates to a motorization unit characterized in that it is provided with means to keep the cooling circuit of one of the engines not running, at the right temperature using the cooling circuit of the other engine which is running, when the unit is operating in alternate mode.

According to a preferred embodiment, said means for keeping one of the cooling circuits at the right temperature comprise at least one heat exchanger connected independently to each of said engines' cooling circuits.

According to one advantageous embodiment, said means also comprise a circulating pump fitted on each of said cooling circuits.

When said unit is designed in such a way that each cooling circuit comprises an expansion vessel, and a water pump coupled to the engine's input shaft, said exchanger is fitted between the expansion vessels and the water pumps of both the cooling circuits of said independent engines, on the water pumps' supercharging circuits.

To allow thermosiphon circulation in the cooling circuit of the engine not running, said heat exchanger is preferably located at a lower level than at least one part of this engine.

BRIEF DESCRIPTION OF THE DRAWINGS

The present invention will be more fully disclosed in the description of a preferred embodiment and an alternative, given by way of non-limitative examples, and with reference to the attached drawings, in which.

DETAILED DESCRIPTION OF THE PREFERRED EMBODIMENTS

Figure 1:
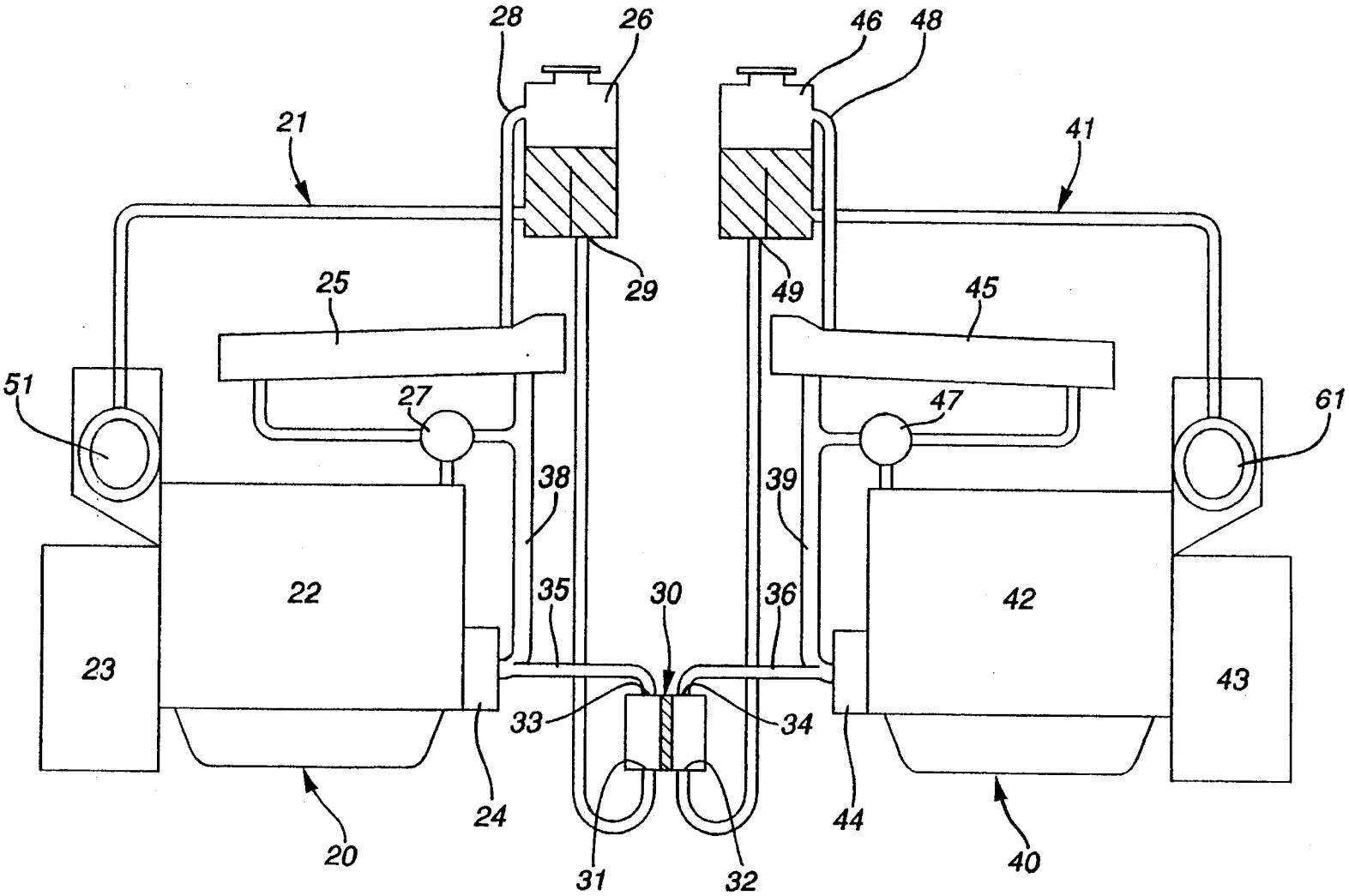
FIG. 1 illustrates a first embodiment of a motorization unit according to the invention.

With reference to FIG. 1, the motorization unit illustrated schematically comprises a first internal combustion engine 20 and a second internal combustion engine 40, each equipped with its own cooling circuit 21, respectively 41. The two cooling circuits 21 and 41 are thermally coupled by a heat exchanger 30.

The engines 20 and 40 respectively comprise a unit power plant 22, 42 combined with an alternator 23, 43 and a water pump 24, 44.

The cooling circuits 21, 41 respectively comprise a water radiator 25, 45, an expansion vessel 26, 46 and a thermostatic valve 27, 47.

The expansion vessels 26, 46 each comprise an input 28, 48 respectively connected to the corresponding radiator 25, 45 and an output 29, 49 respectively connected to separate inputs 31 and 32 on the heat exchanger 30. This exchanger comprises two outputs respectively 33 and 34 which are connected by two conduits 35 and 36, which are part of what is commonly called the supercharging circuit, to the inputs of the water pumps 24 and 44, parallel to the conduits 38 and 39 connecting these pumps to the radiators 25, 45.

The two engines each comprise an oil cooling circuit which is primarily made up of a water/oil heat exchanger respectively 51 and 61.

Provided that the heat exchanger is placed as low as possible in relation to the engines 20, 40, the system operates according to the thermosiphon circulation principle. Indeed, by assuming that the engine 22 is running, the cooling liquid circulates normally in the cooling circuit 21 and particularly in the left-hand compartment (on FIG. 1) of the heat exchanger 30. The heat is transmitted to the right-hand compartment (on FIG. 1) of this exchanger. As the latter is placed at a level lower than that of the engine, the cooling liquid in tact becomes a liquid which heats up the engine 40 or keeps it at the right temperature whilst it is momentarily not running. The liquid circulates in the same direction as when the engine is running.

The solution whereby the thermosiphon circulation principle is applied is particularly attractive because, apart from installing the heat exchanger 30, it does not require any structural modifications to the engines. In practice, the exchanger's two compartments simply have to be inserted between the input and output of the first and second engine's supercharging circuits respectively.

Figure 2:
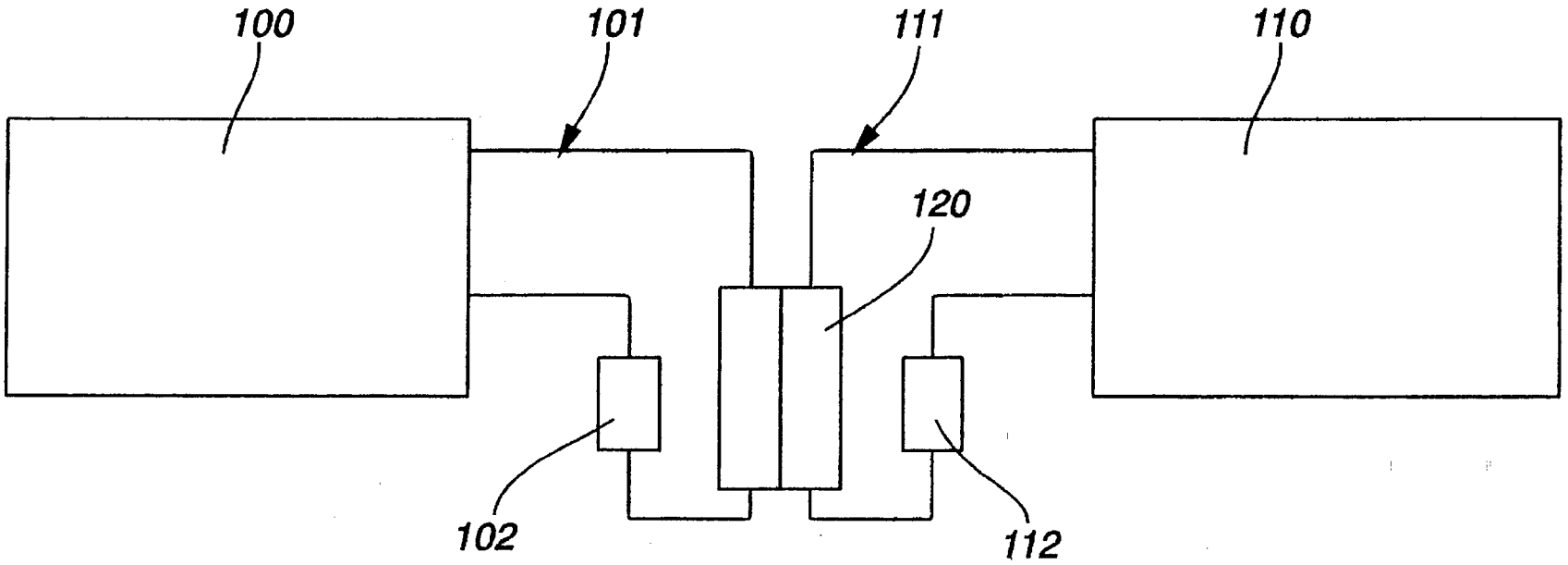
FIG. 2 illustrates a second embodiment of a motorization unit according to the invention.

An alternative to this system is illustrated by FIG. 2. In this schematically illustrated embodiment, the unit comprises two independent engines 100, 110 each with its cooling circuit 101, respectively 111. The cooling circuits each comprise a pump 102, 112 to circulate the cooling liquid and they are connected to a heat exchanger 120. In this embodiment, the cooling liquid is circulated in the circuit of the engine which is not running, by means of the corresponding pump. This solution therefore consumes more energy than the previous one.

Whatever the type of embodiment adopted, the twin-engined motorization concept offers many advantages. One of these advantages, which can be considered as obvious, is that it drastically reduces the probability of a locomotive of this type stopping on the line, which therefore correspondingly reduces a very high risk factor for the operators of a railroad line. The probability of a single-engined locomotive stopping on the line is 0.2% and it drops to 0.0004% for a twin-engined locomotive.

Another advantage, which on the other hand is totally unexpected, stems from the fact that the specific weight of an internal combustion engine and that of the peripheral components, such as the alternators, for example, increases with the unit capacity.

The same tendency can be seen with regard to the manufacturing costs. Consequently, by replacing one engine with a rating of Po on a locomotive by two engines with a rating of ½ Po, it is possible to reduce both the unit's weight and its cost of manufacture.

Furthermore, when in operation, we know that the power taken up is less than half the rating for at least 80% of the time the unit is in use.

On a twin-engined motorization unit, it is therefore possible to use just one engine 80% of the time, which has a beneficial effect on the periodic maintenance required, consumption and polluting emissions.

In practice, as well as keeping the right temperature, the oil circuit has to remain full. A pre-grease pump, which these engines usually have, can be used for this purpose. This is a small, low-consumption pump. Furthermore, the oil is kept at the right temperature through the water/oil exchanger which is generally used to cool this oil, when the engine is running.

The invention is not restricted to the embodiments described and can undergo various modifications and be presented in a variety of alternatives which are obvious to the expert.

I claim:

1. A motorization unit, for road, rail, and aquatic vehicles, comprising:

at least two internal combustion engines, each of the engines having an independent cooling circuit; and a control means for operating the at least two engines at least one of alternately and simultaneously;

wherein at least one heat exchanger is thermally coupled to the cooling circuits of each of the engines, to, in the event that one of the at least two engines is running and the other of the at least two engines is not running, transfer heat from the cooling circuit of the engine that is running to the cooling circuit of the engine that is not running and heat the engine that is not running.

2. A motorization unit according to claim 1, wherein each of the cooling circuits further comprise a circulating pump to, when one of the at least two engines is running and the other of the at least two engines is not running, circulate cooling fluid in the engine that is not running and facilitate heat transfer.

3. A motorization unit according to claim 1, wherein each of the cooling circuits further comprise an expansion vessel and a water pump coupled to an input shaft of the corresponding engine to circulate cooling liquid in the cooling circuit, with the heat exchanger being located in the cooling circuit between the expansion vessel and the water pump.

4. A motorization unit according to claim 3, wherein each of the cooling circuits further comprise a supercharging circuit for a corresponding one of the engines and the heat exchanger is located in the supercharging circuit.

5. A motorization unit according to claim 3, wherein, in each of the cooling circuits, the heat exchanger is located at a level lower than at least a part of a corresponding one of the engines to circulate cooling liquid in the cooling circuit via thermosiphon circulation.

6. A motorization unit according to claim 1, wherein, in each of the cooling circuits, the heat exchanger is located lower than at least a part of a corresponding one of the engines to circulate cooling liquid in the cooling circuit via thermosiphon circulation.

* * * * *

UNITED STATES PATENT AND TRADEMARK OFFICE

CERTIFICATE OF CORRECTION

PATENT NO. : 5,553,576
DATED : September 10, 1996
INVENTOR(S) : Jean Nikly

It is certified that error appears in the above-identified patent and that said Letters Patent is hereby corrected as shown below:

Title page,
Replace item [73] with:
-- [73] Assignee: WARTSILA SACM DIESEL S.A., Mulhouse, France --

Signed and Sealed this

Nineteenth Day of March, 2002

*Attest:*

*Attesting Officer*

JAMES E. ROGAN
*Director of the United States Patent and Trademark Office*